United States Patent [19]

Riggins

[11] 4,202,570

[45] * May 13, 1980

[54] DOOR LOCK FOR SLIDING DOORS

[76] Inventor: Robert J. Riggins, 1503 Rand St., Boise, Id. 83705

[ * ] Notice: The portion of the term of this patent subsequent to Jul. 13, 1994, has been disclaimed.

[21] Appl. No.: 574,492

[22] Filed: May 5, 1975

[51] Int. Cl.[2] ..... E05C 5/00
[52] U.S. Cl. ..... 292/60
[58] Field of Search ..... 292/60, 57, 58, 59, 292/61, 67

[56] References Cited

U.S. PATENT DOCUMENTS

| | | | |
|---|---|---|---|
| 777,099 | 12/1904 | Hillyard | 292/60 |
| 1,064,313 | 6/1913 | Garlock | 292/60 |
| 2,784,023 | 3/1957 | Pisani | 292/60 X |

*Primary Examiner*—Richard E. Moore
*Attorney, Agent, or Firm*—Paul F. Horton

[57] ABSTRACT

The latch for sliding panels comprises a spring-loaded bolt assembly carried on the panel by means of a mounting plate, and catchplate fixedly mounted to the casement. The bolt and bolt receiving holes in the catchplate being oriented at acute angles to the vertical. By this structure, force applied on the panel results in increased engagement of the bolt into the receiving holes.

2 Claims, 5 Drawing Figures

DOOR LOCK FOR SLIDING DOORS

FIELD OF INVENTION

The present invention relates to latching devices, and more particularly to latching devices as applied to slidable casements and the like.

BRIEF DESCRIPTION OF THE PRIOR ART

Latches have long been used as means for retaining sliding doors and windows in opposition. Latches for sliding doors and windows of the prior art are characterized as structures comprising a bolt slidably mounted in brackets engageable with a catch. Almost universally, the bolt is designed to ride perpendicularly to the travel of the sliding panel, which may provide either door or window. This results in structure which is only partially satisfactory for its intended use. Because the conventional bolt is disposed perpendicularly to the casement, the bolt is not aligned with the primary lines of force which may be applied to the window, to the sliding panel. This results, in turn, in the latch being highly susceptible to circumvention by burglars, and the like.

Accordingly, as an object of the present invention, to provide a latch for sliding doors, windows, and the like, which includes a bolt which is more in alignment with the primary lines of force which are customarily applied to the sliding panel.

It is another object of this invention to provide the aforesaid latch in combination with mounting plates and brackets, which may secure and cooperate said bolt.

It is a further object to this invention that the present latch be of simple and highly durable construction.

These and other objects shall become apparent from the description following, it being understood that modifications may be made without affecting the teachings of the invention here set out.

SUMMARY OF INVENTION

The latch for sliding panels comprises a spring-loaded bolt assembly carried on the panel by means of a mounting plate, and catchplate fixed mounted to the casement. The bolt and bolt receiving holes in the catch plate being oriented at acute angles to the vertical. By this structure, force applied on the panel results in increased engagement of the bolt into the receiving holes.

A more thorough and comprehensive understanding may be had from the detailed description of the preferred embodiment when read in connection with the drawings forming a part of this specification.

BRIEF DESCRIPTION OF THE DRAWINGS

FIG. 3 is a further embodiment of the catchplate as applied to sliding doors and the like.

DETAILED DESCRIPTION OF THE PREFERRED EMBODIMENT

Figure 1:
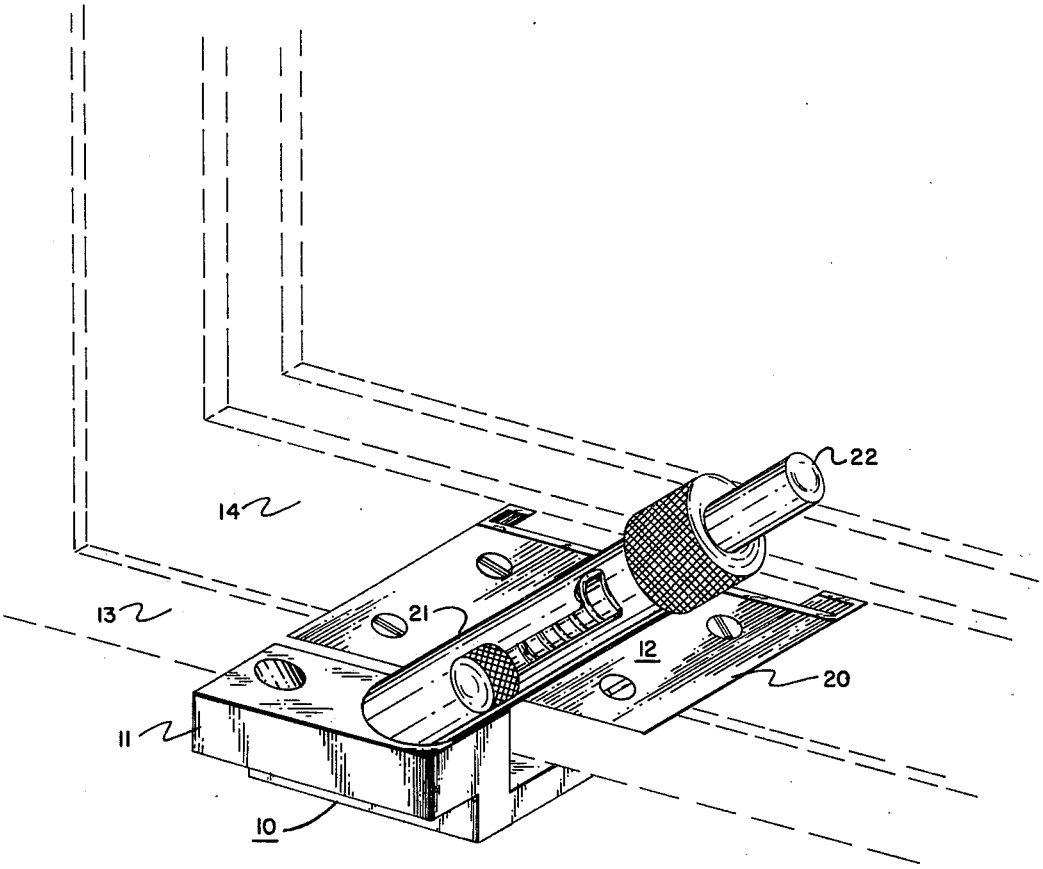
FIG. 1 is a perspective view of the lock latch for sliding encasements of this invention shown in its environment drawn in broken lines for illustrative purposes.

Referring now to the drawings and more particularly to the FIG. 1, the latch for sliding panels for this invention is shown to advantage and generally identified by the numeral 10. The latch 10 comprises a catchplate 11, and a bolt assembly 12. The latch 10 is intended to operate with any of a variety of sliding door or window assemblies or conventional casements 13, and sliding panels 14.

Figure 2:
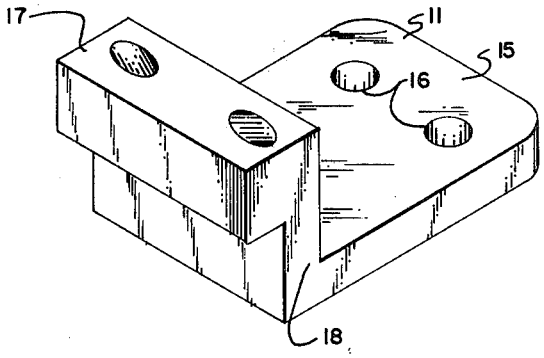
FIG. 2 is a perspective view of the catchplate of the present lock.
Figure 3:
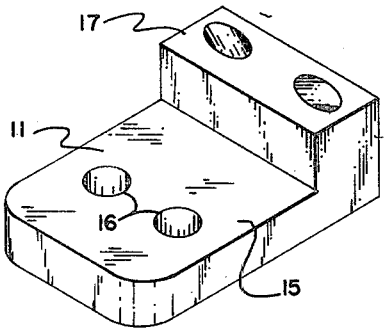

The catch 11 provides the fixed means receiving the bolt assembly 12. Accordingly, the catch 11 is intended to be mounted to the casement 13 for convenience, it has been found to advantage to fabricate the catch 11, so that the catch 11 may be mounted between the exterior of the casement 13, and the building member supporting the window structure. As shown more clearly in the FIG. 2, that catch is fabricated with a flange 15 having the same length dimension as the width dimension of the casement 13. The flange 15 is provided with suitably disposed holes 16 for receiving fasteners (not shown). The bolt assembly 12 engages a striker plate portion 17, which is carried on a web portion 18, which issues upwardly from the uppermost terminal side of one of the edges of the flange 15. The web portion 18 is of suitable size to juxtapose the strike plate portion 17 flush with the interior edge of the casement 13. The portion 17 may be fabricated with an offset configuration on its exposed side for structures, such as sliding windows, where compactness is of the advantage. As shown in the FIG. 3 a further embodiment of the catch 11 may be adapted for sliding doors, and the like, wherein vertical demension is to be minimized. In the latter embodiment, the catch 11 comprises a flange 15 substantial of the same type as described above, and a striker plate portion 17, which is contiguous with the flange 15. At least one hole 19 is bored at acute angle to the vertical into the uppermost face of the strikerplate portion 17, to engage the bolt assembly 12.

Figure 4:
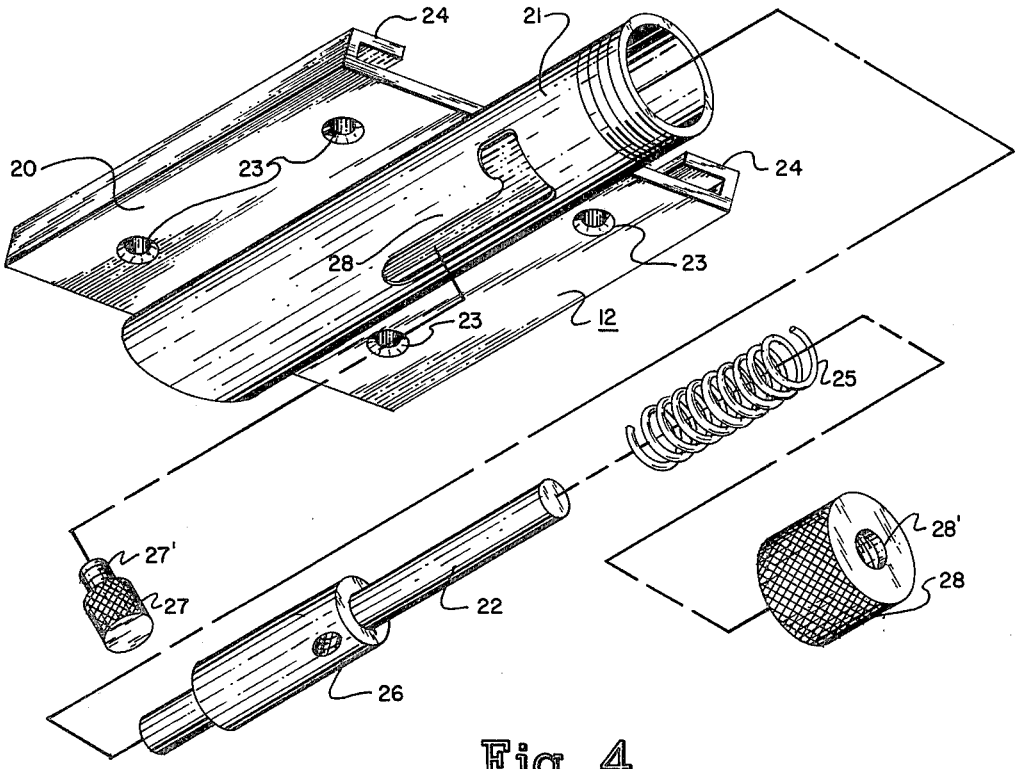
FIG. 4 is an exploded view of the latch assembly of the present invention.
Figure 5:
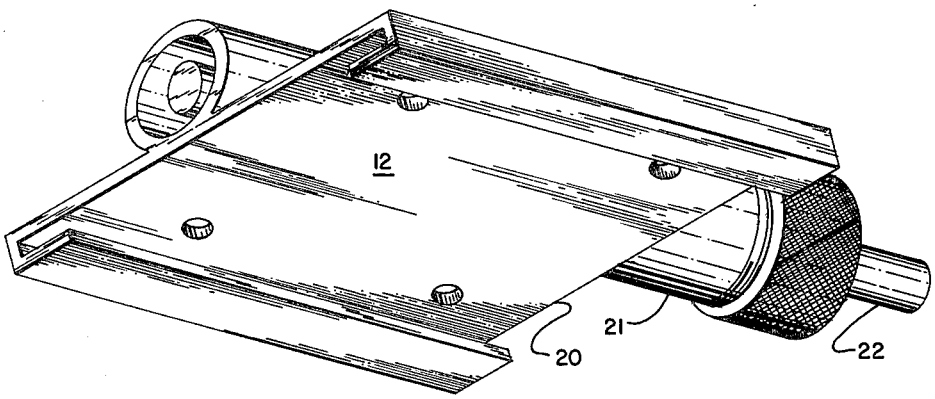
FIG. 5 is a perspective view of the latch assembly as viewed from its lower side.

Referring again to the FIG. 1, the bolt assembly 12 is intended to ride on the interior vertical face of the sliding panel 14. Accordingly, the bolt assembly 12 comprises a mounting plate 20, a bolt guide barrel 21, and a bolt 22. As shown more clearly in the FIGS. 4 and 5, the mounting plate 20 is a substantially flat member provided with a plurality of holes 23 for engaging fasteners (not shown) securing the assembly 12 to the panel 14. The plate 20 may be provided at each of its terminal sides with return flanges 24, which are operable to engage portions framing the panel 14.

The bolt guide 21 is a cylindrical member joined to the exterior face of the mounting plate 20, at an oblique angle to the intended vertical axis. The bolt guide 21 is a hollow cylindrical member joined to the exterior face of the mounting plate 20, at an acuted angle to the intended vertical axis. The bolt 22 is a cylindrical roundlike member operable to frictionously ride with the barrel 21. As shown in the FIG. 4, the bolt 22 is intended to be the lowermost terminal end of the barrel 21. Accordingly, a coil spring 25 is disposed about the bolt 22; or the bolt 22 is provided with a shoulder 26 against which the spring 25 may act. The urged bolt 22 is retained in the barrel 21 by an operating knob 27, which is secured essentially in the rod 22 to the shoulder 25 by a stem 27'. The stem 27' communicates through slot 28 in the cylindrical walls of the barrel 21. The assembly 12 is assembled by inserting the bolt 22 into the barrel 21 with the spring 25 riding about the bolt 22 on the shoulder 26. The operating knob 27 is engaged with the shoulder 26 through the slot 28. A cap 28 is secured about the terminal and of the barrel 21, at the end corresponding to the end of the rod 22 carrying the spring 25. A hole 28' is disposed centrally in an flat endwall 28'' of the cap 21, to receive the bolt 22. In this way the spring 25 is operable to act against the shoulder 26 and the interior of the cap 28.

Referring again to the FIG. 1, the panel 14 is operable to slide in encasement 14 in the manner of all conventional sliding windows and structures. The bolt 22 may be seen to be riding at an acute angle to the major axis of the panel 14 (here shown as an acute angle to the vertical of the panel 14). When the bolt 22 has come into registry with one of the holes 17' with a catch 11, the lowermost terminal end of the catch 22 engages the corresponding acutely oriented hole 17'. It is intended that the acute vertex formed by the orientation of the rod 22 and hole 17' be disposed in the direction of opening of the panel 14. Thus, force applied in the direction of inclination of the bolt 22 in the hole 17' results in further engagement of the bolt 22 with the catch 11. It has been found to advantage to configure the slot 28 in an inverted L-shaped or J-shaped configuration in which the major leg of the slot 28 is disposed in alignment with the rectilinear axis of the barrel 21. In this way, the necessary travel of the bolt 22 is defined, and means for retaining the bolt 22 in a retracted position (in which the bolt 22 does not engage the catch 11) is provided.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein, hence, it is intended that the scope of the invention be limited only to the extent indicated in the appended claims.

I claim:

1. A latch for sliding panel structures which include a fixed casement and a panel slidably mounted in said casement, comprising:

a catch comprising a flanged portion and a striker plate portion issuing from one of the terminal ends of said flange, the uppermost terminal side of said striker plate portion including at least one hole being bored at an acute angle; and a bolt assembly including a mounting plate, a hollow cylindrical barrel jointed at an acuted angle to said striker plate, a bolt slidably carried within said barrel, said mounting plate being fastened to said sliding panel, and said catch being mounted to said casement suitably for said bolt to be engageable with said acutely oriented hole of said catch, means urging said bolt in the direction of said catch, and means determining travel of said bolt in said barrel, said means determining the travel of said bolt is provided by a slot having a major portion thereof disposed in alignment with the rectilinear axis of said barrel, and an operating knob connected to said rod by means of a stem which is disposed through said slot.

2. The article of claim 1 wherein said means urging said bolt from said barrel comprises a coil spring disposed about said bolt acting against a shoulder carried on said bolt and against a cap which has a hole through which said bolt communicates, and which is suitably secured to the terminal end of said barrel corresponding to the bolt end carrying said spring.

* * * * *